US009777684B2

(12) United States Patent
Magel et al.

(10) Patent No.: US 9,777,684 B2
(45) Date of Patent: Oct. 3, 2017

(54) FUEL INJECTION VALVE FOR INTERNAL COMBUSTION ENGINES

(71) Applicant: Robert Bosch GmbH, Stuttgart (DE)

(72) Inventors: Hans-Christoph Magel, Reutlingen (DE); Andreas Gruenberger, Spraitbach (DE)

(73) Assignee: Robert Bosch GmbH, Stuttgart (DE)

( * ) Notice: Subject to any disclaimer, the term of this patent is extended or adjusted under 35 U.S.C. 154(b) by 273 days.

(21) Appl. No.: 14/411,895

(22) PCT Filed: May 15, 2013

(86) PCT No.: PCT/EP2013/060078
§ 371 (c)(1),
(2) Date: Dec. 29, 2014

(87) PCT Pub. No.: WO2014/000957
PCT Pub. Date: Jan. 3, 2014

(65) Prior Publication Data

US 2015/0159607 A1 Jun. 11, 2015

(30) Foreign Application Priority Data

Jun. 29, 2012 (DE) ..... 10 2012 211 239
Nov. 2, 2012 (DE) ..... 10 2012 220 025

(51) Int. Cl.
*F02M 47/02* (2006.01)
*F02M 63/00* (2006.01)
*F02M 61/20* (2006.01)

(52) U.S. Cl.
CPC ..... *F02M 47/02* (2013.01); *F02M 47/027* (2013.01); *F02M 63/0029* (2013.01);
(Continued)

(58) Field of Classification Search
CPC .. F02M 47/02; F02M 47/027; F02M 63/0029; F02M 63/0042; F02M 63/0043;
(Continued)

(56) References Cited

U.S. PATENT DOCUMENTS 5,209,403 A * 5/1993 Tarr ..... F02M 57/021 239/533.8
5,803,370 A * 9/1998 Heinz ..... F02M 45/08 239/533.9
(Continued)

FOREIGN PATENT DOCUMENTS

DE 10024702 11/2001
DE 10131617 1/2003
(Continued)

OTHER PUBLICATIONS

International Search Report for Application No. PCT/EP2013/060078 dated Sep. 11, 2013 (English Translation, 3 pages).

*Primary Examiner* — Arthur O Hall
*Assistant Examiner* — Adam J Rogers
(74) *Attorney, Agent, or Firm* — Michael Best & Friedrich LLP

(57) ABSTRACT

The invention relates to a fuel injection valve comprising a housing (1) in which pressure is applied to a nozzle needle (8), in a control chamber (28), at least indirectly with a closing force in the direction of a valve seat (10). The pressure in the control chamber (28) can be adjusted using a control valve (40) as said control chamber (28) is able to be connected to a low pressure chamber (46) via an outlet restrictor (31) and be filled with fuel at high pressure via an inlet restrictor (30). A longitudinally-displaceable control piston (29) is arranged in the control chamber (28) and divides said chamber (28) into a first control sub-chamber and a second control sub-chamber (228), the first control sub-chamber (128) being able to be connected to the low
(Continued)

pressure chamber (46) by means of said outlet restrictor (31). A sealing surface (38) is formed on the control piston (29) and interacts with a sealing seat (39) in the control chamber (28) such that the inlet restrictor (30) is hydraulically disconnected from the second control sub-chamber (228) when the sealing surface (38) comes to rest against the sealing seat (39). Said first control sub-chamber (128) and second control sub-chamber (228) are constantly hydraulically interconnected by means of a restrictor connection (34).

9 Claims, 6 Drawing Sheets

(52) U.S. Cl.
CPC .... *F02M 63/0042* (2013.01); *F02M 63/0043* (2013.01); *F02M 63/0075* (2013.01); *F02M 61/20* (2013.01); *F02M 2547/003* (2013.01)

(58) Field of Classification Search
CPC ..... F02M 63/0075; F02M 61/20; F02M 2547/003
USPC ..... 239/533.8
See application file for complete search history.

(56) References Cited

U.S. PATENT DOCUMENTS

| | | | | |
|---|---|---|---|---|
| 5,984,201 | A * | 11/1999 | Hofmann | F02M 45/08 239/127 |
| 6,705,551 | B1 * | 3/2004 | Kienzler | F02M 47/02 239/533.11 |
| 2002/0134853 | A1 * | 9/2002 | Stoecklein | F02M 47/027 239/88 |
| 2003/0062492 | A1 * | 4/2003 | Haeberer | F02M 47/027 251/64 |
| 2004/0169094 | A1 * | 9/2004 | Bloching | F02M 47/02 239/533.2 |
| 2008/0264157 | A1 * | 10/2008 | Degler | F02D 41/20 73/114.45 |
| 2011/0186647 | A1 * | 8/2011 | Bernhaupt | F23D 11/28 239/5 |
| 2012/0205470 | A1 * | 8/2012 | Spindler | F02M 47/027 239/585.5 |

FOREIGN PATENT DOCUMENTS

| | | | | |
|---|---|---|---|---|
| DE | 102007055895 | | 7/2008 | |
| DE | WO 2011057863 | A1 * | 5/2011 | F02M 47/027 |
| EP | 2093410 | | 8/2009 | |
| JP | 2011190746 | | 9/2011 | |
| JP | 2011208554 | | 10/2011 | |
| WO | 2010088781 | | 8/2010 | |

* cited by examiner

FUEL INJECTION VALVE FOR INTERNAL COMBUSTION ENGINES

BACKGROUND OF THE INVENTION

The invention relates to a fuel injection valve for internal combustion engines, such as is preferably used for the injection of fuel into a combustion chamber of an auto-ignition internal combustion engine.

Injection systems for the injection of fuel into combustion chambers at high pressure are known from the prior art. Here, fuel is compressed by a high-pressure pump and is temporarily stored in a high-pressure accumulator, a so-called rail. Said high-pressure accumulator provides a feed to one or more fuel injection valves which inject the required fuel into the respective combustion chamber. It is an aim here for exactly the required fuel quantity to be introduced into the combustion chamber as finely atomized and spatially uniform a manner as possible. DE 100 24 702 A1, for example, presents an injection system of said type together with injection valve.

To control the injection, the known fuel injection valves have a nozzle needle which is arranged in longitudinally displaceable fashion in a housing and which, to open and close at least one injection opening, interacts with a nozzle seat. The movement of the nozzle needle is in this case controlled by the pressure in a control chamber, said pressure acting on that face surface of the nozzle needle which faces away from the valve seat. By means of a control valve, the pressure in the control chamber is lowered or raised, which correspondingly changes the closing force on the nozzle needle, such that said nozzle needle, driven by the hydraulic force of the fuel which is at injection pressure and which surrounds the nozzle needle, moves in a longitudinal direction.

The pressure in the control chamber is achieved through the inflow and outflow of pressurized fuel. In the known fuel injection valves, the control chamber is permanently connected to pressurized fuel via an inflow throttle which connects the control chamber to a high-pressure line within the fuel injection valve. To lower the pressure in the control chamber, the control chamber can be connected via an outflow throttle to a low-pressure chamber, wherein the outflow throttle can be opened or closed by means of a control valve. When the outflow throttle is open, pressurized fuel thus flows out of the control chamber into the low-pressure chamber, wherein the pressure in the control chamber, and thus the closing force on the nozzle needle, decrease. This so-called discharge quantity is basically unavoidable owing to the construction principle.

When the control valve is open, fuel flows constantly into the control chamber via the inflow throttle, said fuel expanding in the control chamber and flowing onward into the low-pressure chamber. Said fuel must be compressed by the high-pressure pump in addition to the fuel intended for injection, which reduces the efficiency of the injection system.

To increase the efficiency of the injection system, DE 101 31 617 A1 has disclosed a fuel injection valve in which the fuel pressure in the control chamber is controlled by way of a 3/2 directional valve. Depending on the position of said control valve, fuel either flows from a high-pressure line via an inflow and outflow throttle into the control chamber, or is discharged into a low-pressure chamber. The control by way of a 3/2 directional valve is however cumbersome and expensive. Furthermore, the build-up and dissipation of pressure in the control chamber is relatively slow in the case of this embodiment.

SUMMARY OF THE INVENTION

The fuel injection valve according to the invention is, by contrast, capable of considerably reducing the fuel discharge quantity using simple means without the dynamics of the control being adversely affected. For this purpose, a control piston is arranged in longitudinally displaceable fashion in the control chamber, which control piston divides the control chamber into a first control chamber part and a second control chamber part, wherein the first control chamber part can be connected to a low-pressure chamber via an outflow throttle and the first control chamber part is permanently hydraulically connected to the second control chamber part via a connecting throttle. On the control piston there is formed a sealing surface which interacts with a sealing seat such that, when the sealing surface is in contact with the sealing seat, the second control chamber part is hydraulically separated from the inflow throttle. Here, the control piston is not moved by further actuators or other control devices; it is moved exclusively by the hydraulic forces acting on it. The construction is correspondingly easy and inexpensive to realize.

As a result of the closure of the inflow throttle, it is the case during a major part of the opening phase of the fuel injection valve that no fuel flows into the control chamber and is expanded onward from there, without further benefit to the fuel injection system, into the low-pressure chamber. This increases the efficiency of the fuel injection system and thus reduces the fuel consumption of a motor vehicle equipped with a fuel injection system of said type.

In a first advantageous embodiment of the invention, the connecting throttle is formed in a valve piece in which the control piston is guided. This permits a wide range of variability with regard to the arrangement of the control piston and valve piece, and reduces the production costs in relation to a configuration with guidance directly in the housing of the fuel injection valve. Furthermore, the connecting throttle can advantageously be formed in the valve piece. Alternatively, the connecting throttle may also be formed in the control piston itself.

In a further advantageous embodiment of the invention, there is formed in the outer surface of the control piston an annular groove into which the inflow throttle issues. The annular groove is separated from the second control chamber part when the sealing surface is in contact with the sealing seat. Since the annular groove has the same effective hydraulic surface area in both directions of longitudinal movement of the control piston, the fuel in the annular groove does not give rise to a hydraulic force acting on the control piston in the longitudinal direction, which would have to be compensated.

In a further advantageous embodiment, the control piston is subjected, by a spring element, to an opening force away from the sealing seat. Here, the force of the spring element serves to move the control piston into a defined initial position in order to ensure a distinct function. The spring element may in this case advantageously be arranged in the second control chamber part, such that the first control chamber part can be kept very small, which permits rapid switching of the fuel injection valve.

BRIEF DESCRIPTION OF THE DRAWINGS

Further advantages and advantageous refinements of the invention will emerge from the description and from the drawing.

Multiple exemplary embodiments of the invention are illustrated in the drawing, in which.

DETAILED DESCRIPTION

Figure 1:
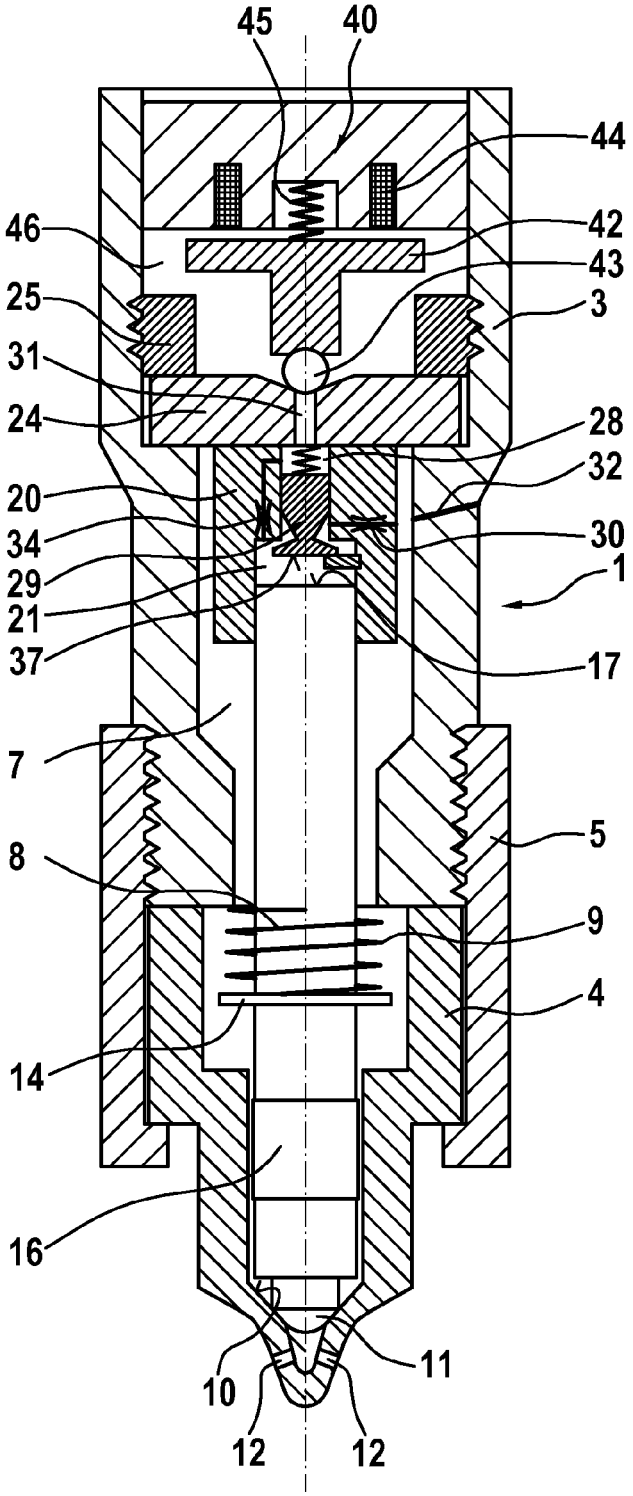
FIG. 1 shows a fuel injection valve according to the invention in longitudinal section.

FIG. 1 schematically illustrates a fuel injection valve according to the invention in longitudinal section. The fuel injection valve has a housing 1 which has a holding body 3 and a nozzle body 4 which are braced against one another by means of a clamping nut 5. In the holding body 3 and in the nozzle body 4 there is formed a pressure chamber 7 which can be filled with fuel at high pressure via a high-pressure port 32. In the pressure chamber 7 there is arranged, in longitudinally displaceable fashion, a nozzle needle 8 which, on its end which faces toward an internal combustion engine in an installed position, has a valve sealing surface 11 by means of which the nozzle needle 8 interacts with a nozzle seat 10 and thereby controls the connection of multiple injection openings 12, which are formed in the nozzle body 4, to the pressure chamber 7. In this case, the nozzle needle 8 is guided, in the region of the nozzle body 4, in a guide section 16, wherein the fuel flow through the pressure chamber 7 in the direction of the injection openings 12 past the guide section 16 is ensured by means of one or more ground portions on the guide section 16. Also arranged in the nozzle body 4 is a closing spring 9 which surrounds the nozzle needle 8 and which is supported, under compressive preload, with one end against the holding body 3 and with the other end against a shoulder 14 formed on the nozzle needle 8, said closing spring thereby exerting a closing force on the nozzle needle 8 in the direction of the valve seat 10.

At the end remote from the nozzle seat, there is arranged in the pressure chamber 7 a valve piece 20 which is supported against a throttle plate 24, which throttle plate forms that end of the pressure chamber 7 which faces away from the valve seat, and which throttle plate may also be formed in one piece with the valve piece 20. In this case, the throttle plate 24 is braced by means of a clamping screw 25 against a shoulder in the holding body 3. In the valve piece 20 there is formed a stepped bore 21, 22 which comprises a guide bore 22 of reduced diameter and a bore section 21 of widened diameter. The nozzle needle 8, by way of its end which faces away from the nozzle seat and on which the face side 17 is formed, projects into the widened bore section 21 and is guided radially therein. The guide bore 22, the throttle plate 24 and the face side 17, facing away from the valve seat, of the nozzle needle 8 delimits a control chamber 28. In this case, the control chamber 28 is connected to the pressure chamber 7 by an inflow throttle 30 formed in the valve piece 20 and to a low-pressure chamber 46 via an outflow throttle 31, said low-pressure chamber being connected to a return line (not illustrated in the drawing) such that a low pressure prevails in the low-pressure chamber 46 at all times.

For the opening and closing of the outflow throttle 31, a control valve 40 is arranged in the housing 1 on that side of the throttle plate 24 which faces away from the control chamber 28. The control valve 40 comprises a magnet armature 42, wherein a sealing ball 43 is arranged on that end of said magnet armature which faces toward the throttle plate 24, by means of which sealing ball the magnet armature 42 lies on a seat formed in the throttle plate 24 and thereby closes the outflow throttle 31. The magnet armature 42 is subjected to a closing force in the direction of the throttle plate 24 by a spring 45 and can, by means of an electromagnet 44, be pulled counter to the force of the spring 45 into an open position, such that the sealing ball 43 opens up the outflow throttle 31 and fuel can flow out of the control chamber 28 into the low-pressure chamber 46.

Figure 2:
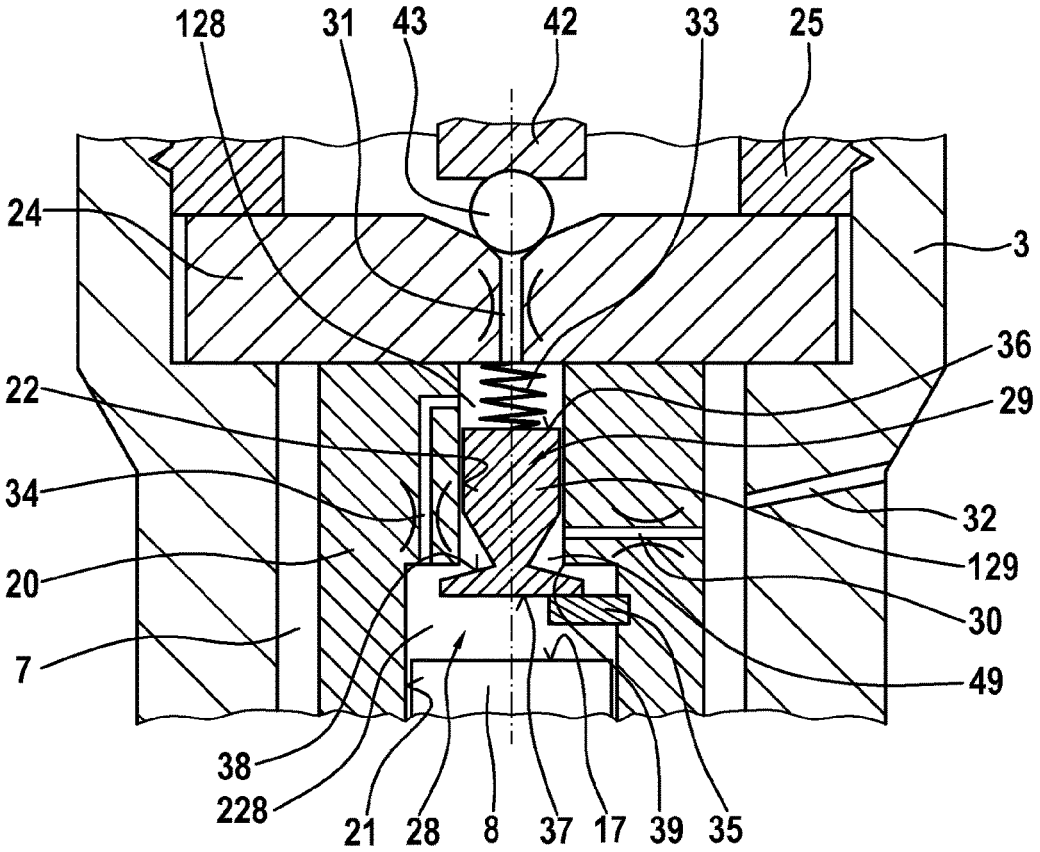
FIG. 2 shows an enlarged detail of FIG. 1 in the region of the control chamber.

FIG. 2 shows the region of the control chamber 28 of FIG. 1 once again on an enlarged scale. To restrict the flow of fuel into the control chamber 28 through the inflow throttle 30, a control piston 29 is arranged in the control chamber 28. The control piston 29 is longitudinally movable in the control chamber 28 and is guided by way of a cylindrical section 129 in the guide bore 22. That end of the control piston 29 which faces toward the nozzle needle 8 is of widened form and, on an outer surface, forms a sealing surface 38 which interacts with a sealing seat 39 formed on the valve piece 20. The movement of the control piston 29 is in this case limited in the direction of the nozzle needle 8 by a stop 35. The control piston 29 divides the control chamber 28 into a first control chamber part 128 and a second control chamber part 228, wherein the first control chamber part 128 is formed between the first face surface 36 of the control piston 29 and the throttle plate 24, and the second control chamber part 228 is formed between the second face surface 37 of the control piston 29 and the face side 17 of the nozzle needle 8. To connect the two control chamber parts 128, 228, there is provided in the valve piece 20 a connecting throttle 34 via which pressure equalization between the two control chamber parts 128, 228 is possible.

In the first control chamber part 128 there is arranged a closing spring 33 which subjects the control piston 29 to an opening force in the direction of the nozzle needle 8 and presses said control piston against the stop 35. Between the cylindrical section 129 of the control piston 29 and the sealing surface 38, there is formed on the outer side of the control piston 29 an annular groove 49 into which the inflow throttle 30 issues. When the control piston 29 is situated in its open position, that is to say is in contact with the stop 35, the second control chamber part 228 is hydraulically connected to the inflow throttle 30 via the annular groove 49, as illustrated in FIG. 2.

The described fuel injection valve functions as follows. At the start of the injection, the control valve 40 is deenergized, such that the magnet armature 42, driven by the closing spring 45, closes the outflow throttle 31. Owing to the connection between the first control chamber part 128 and the second control chamber part 228 via the connecting throttle 34, the same high pressure prevails throughout the control chamber 28, because there is a connection via the inflow throttle 30 to the pressure chamber 7, in which fuel is present at high pressure. If the electromagnet of the control valve 40 is energized, the magnet armature 42 is lifted from the throttle plate 24 and opens up the outflow throttle 31, via which fuel then flows out of the first control chamber part 128 into the low-pressure chamber 46. The pressure in the first control chamber part 128 thereupon falls very rapidly, which reduces the hydraulic forces on the first face side 36 of the control piston 29, whereas the pressure in the second control chamber part 228 remains considerably higher owing to the throttling action of the connecting throttle 34 and the fuel flowing in from the inflow throttle 30. The resulting high hydraulic force on the second face side 37 of the control piston 29 pushes the control piston away from the stop 35 in the direction of the throttle plate 24 until the sealing surface 38 of said control piston comes into contact with the sealing seat 39 and separates the annular groove 49 from the second control chamber part 228. The inflow throttle 30 is now sealed off and the high fuel pressure prevails only within the annular groove 49, while the pressure in the second control chamber part 228 now falls further, also reducing the closing force on the face side 17 of the nozzle needle 8, until said nozzle needle—driven by the hydraulic forces in the pressure chamber 7—is lifted from the nozzle seat 10 and fuel flows out of the pressure chamber 7 to the injection openings 12 and emerges from the fuel injection valve through these.

To end the injection, the energization of the electromagnet 40 is ended, such that the magnet armature 42 travels back into its closed position and closes the outflow throttle 31 again. Driven by the spring 33, the control piston is lifted from the sealing seat 39, as a result of which the annular groove 49 is connected to the second control chamber part 228 again. The pressure in the two control chamber parts 128, 228 then rapidly increases, and the nozzle needle 8 is pushed back into its closed position against the nozzle seat 10, thus ending the injection. The control piston 29 moves in the direction of the nozzle needle 8 until it bears against the stop 35 again.

Since the inflow throttle 30 remains closed by the control piston 29 practically during the entire injection, only a small amount of fuel passes into the low-pressure chamber 46 as a result of the opening and closing of the outflow throttle 31. This reduces the requirement for compressed fuel that would otherwise flow into the control chamber 28 through the inflow throttle 31 during the entire injection. Furthermore, the thermal loading of the control valve 40 is reduced in this way because the fuel that is compressed to high pressure releases a large amount of heat energy as it expands, which heat energy must be dissipated.

Figure 3:
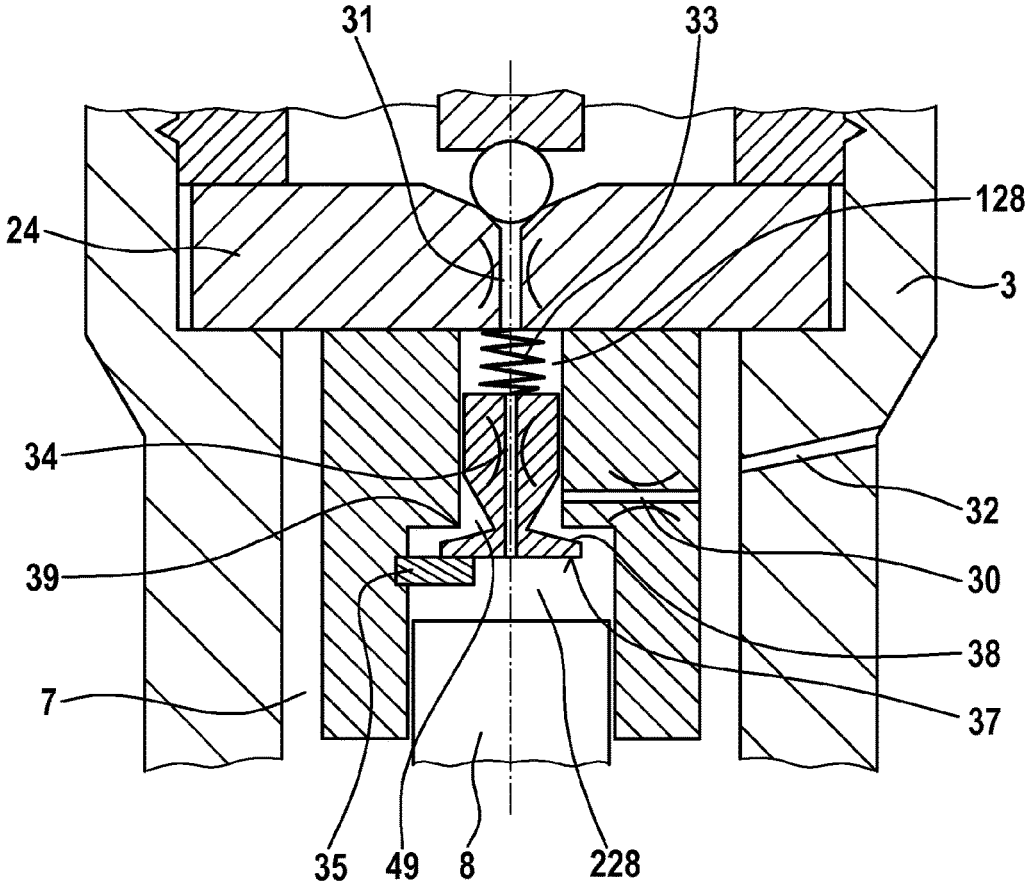
FIGS. 3, 4, 5 and 6 show further exemplary embodiments of the invention in the same form of illustration as FIG. 2.

FIG. 3 shows a further exemplary embodiment, wherein identical parts are denoted by the same reference signs. This exemplary embodiment differs from the exemplary embodiment of FIG. 2 merely in that the connecting throttle 34 is formed not in the valve piece 20 but as a longitudinal bore in the valve piston 29, which is generally easier and less expensive to produce than an angled or oblique bore in the valve piece 20.

Figure 4:
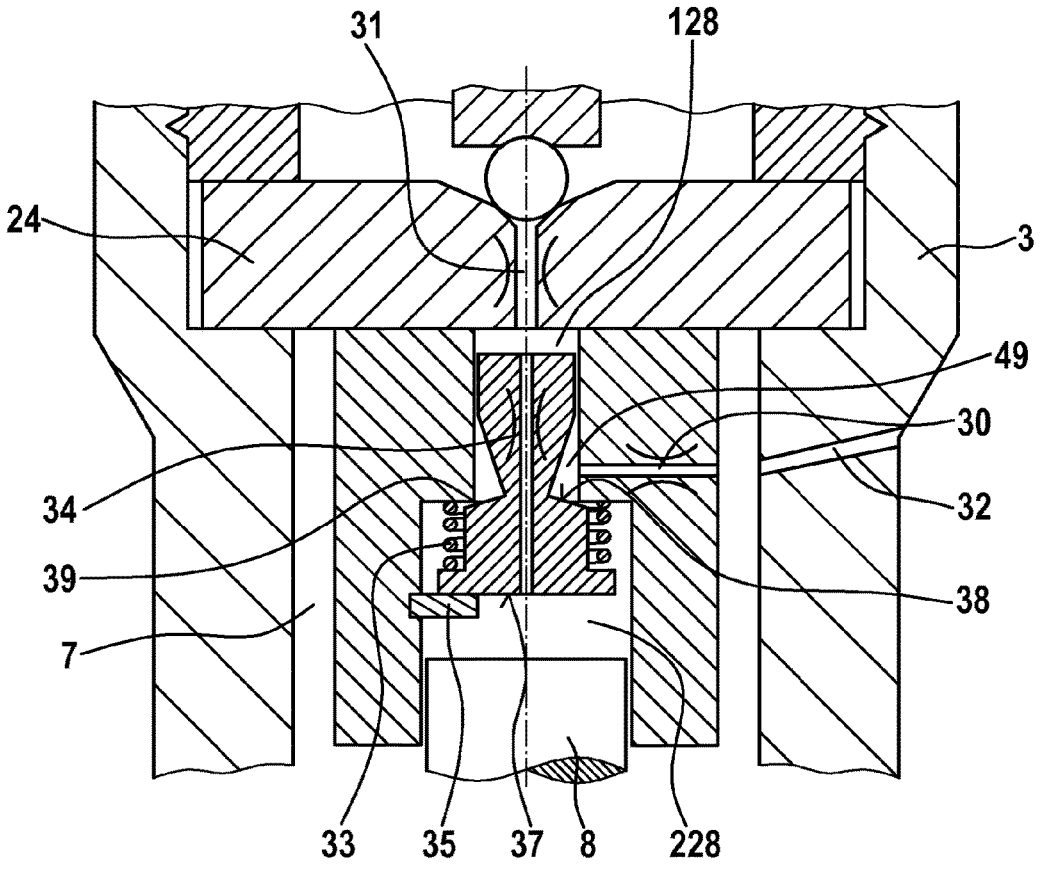

FIG. 4 shows a further exemplary embodiment in the same form of illustration as FIG. 2 and FIG. 3. The control piston 29 is in this case equipped with a further shoulder on the nozzle-side end, wherein the closing spring 33 is arranged between said further shoulder and the valve piece 20, and said closing spring is correspondingly omitted from the first control chamber part 128. This arrangement of the closing spring 33 makes it possible for the first control chamber part 128 to be made very small, whereby the pressure falls very rapidly when the control valve is open and the nozzle needle 8 opens correspondingly rapidly after activation of the control valve 40.

Figure 5:
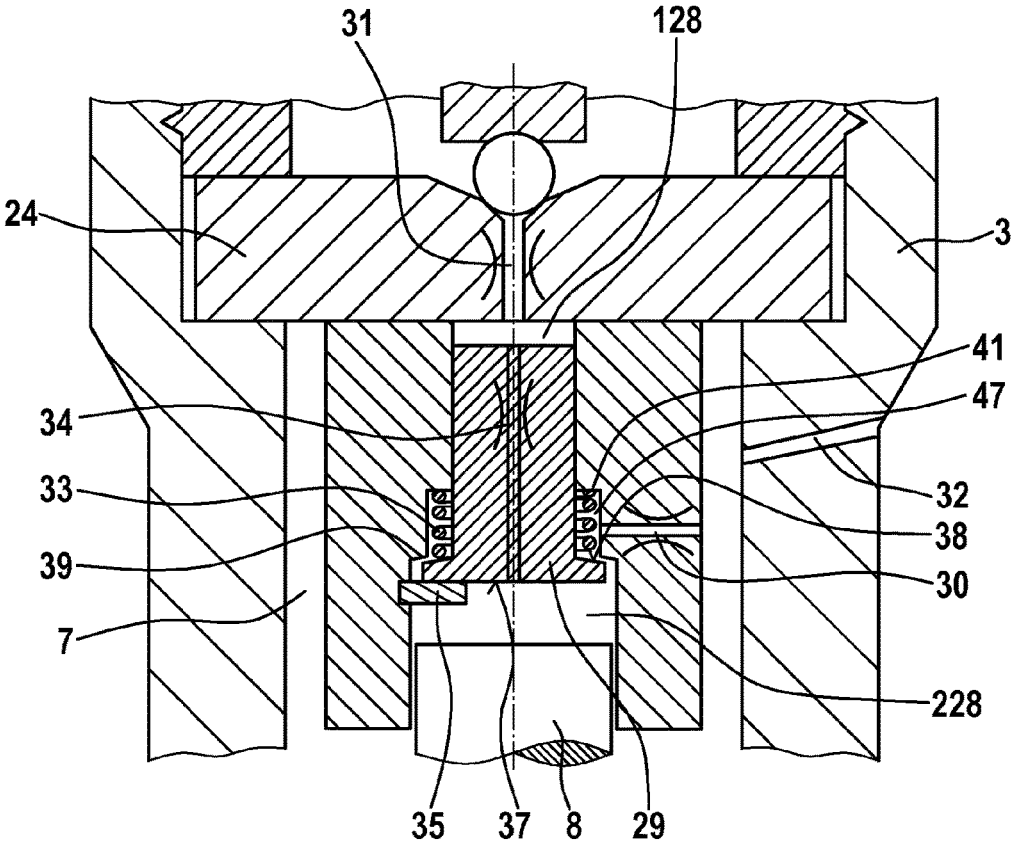

A further exemplary embodiment is illustrated in FIG. 5. In this case, the control piston 29 does not have an annular groove 40 but is of cylindrical form as far as the sealing surface 38. The closing spring 33 bears, by way of its end facing toward the nozzle needle 8, against the sealing surface 38, whereas the other end of the closing spring bears against a shoulder 41 of the valve piece 20. The sealing surface 38 and the shoulder 41 of the valve piece 20 thus form an inflow chamber 47 into which the inflow throttle 30 issues and which accommodates the closing spring 33. In this arrangement, the control piston 29 is of relatively simple form, and the volume of the inflow chamber is further reduced by the closing spring 33, which is advantageous for rapid switching of the control piston 29.

Figure 6:
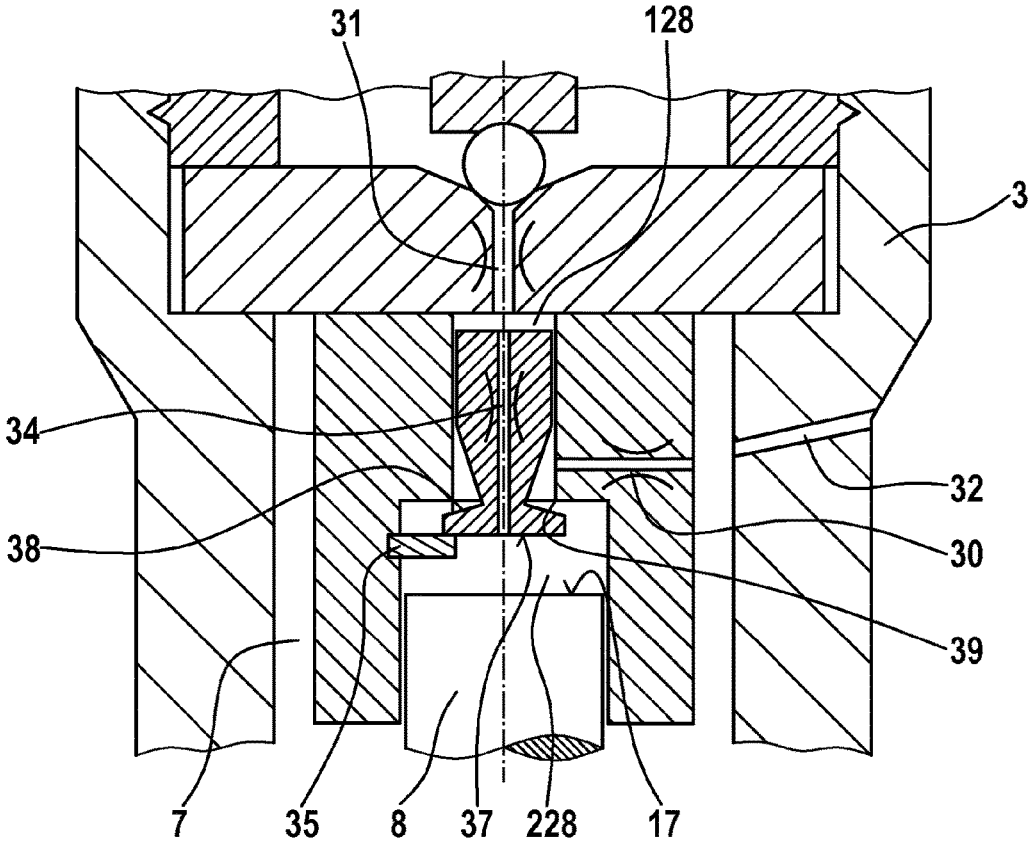

FIG. 6 shows a further exemplary embodiment of the invention, which differs from the exemplary embodiment of FIG. 3 primarily by the omission of the closing spring. The opening of the fuel injection valve is identical to the process discussed above. To nevertheless realize a force on the control piston 8 in the direction of the nozzle needle 8 when said control piston is in contact with the sealing seat 39, the sealing seat 39 can be relocated radially outward slightly. In this way, the resultant hydraulic force acting on the control piston 29 in the longitudinal direction owing to the pressure in the annular groove 49 is no longer zero, and instead, there is a resultant force in the direction of the nozzle needle 8. Now, when the control valve 40 is closed, said force is sufficient to push the control piston 29 away from the sealing seat 39 and produce the connection between the inflow throttle 30 and the second control chamber part 228.

The invention claimed is:

1. A fuel injection valve for internal combustion engines, having a housing (1) in which a nozzle needle (8) is at least indirectly subjected, by pressure in a control chamber (28), to a closing force in a direction of a valve seat (10), wherein the pressure in the control chamber (28) is adjustable by a control valve (40) by virtue of the control chamber (28) being connectable to a low-pressure chamber (46) via an outflow throttle (31) and the control chamber (28) being configured to be filled with fuel at high pressure via an inflow throttle (30), wherein the control chamber (28) has therein a longitudinally movable control piston (29) which divides the control chamber (28) into a first control chamber part (128) and a second control chamber part (228), wherein the first control chamber part (128) is connectable to the low-pressure chamber (46) via the outflow throttle (31), and the control piston having a sealing surface (38) which interacts with a sealing seat (39) in the control chamber (28) such that, when the sealing surface (38) is in contact with the sealing seat (39), the inflow throttle (30) is hydraulically separated from the second control chamber part (228), and wherein the first control chamber part (128) and the second control chamber part (228) are permanently hydraulically connected to one another via a throttled connection (34), and wherein the control piston (29) is subjected, by a spring element (33), to an opening force in a direction of the second control chamber part (228) and the spring element (33) is arranged in the second control chamber part (228).

2. The fuel injection valve as claimed in claim 1, wherein the inflow throttle (30) issues into the second control chamber part (228) when the control piston (28) has lifted from the sealing seat (39).

3. The fuel injection valve as claimed in claim 1, wherein the control chamber (28) is formed in a valve piece (20) in which the control piston (29) is guided.

4. The fuel injection valve as claimed in claim 3, wherein the throttled connection (34) is formed in the valve piece (20).

5. The fuel injection valve as claimed in claim 1, wherein the throttled connection (34) is formed in the control piston (29).

6. The fuel injection valve as claimed in claim 1, wherein the control piston (29) delimits the first control chamber part (128) by way of a first face surface (36) and delimits the second control chamber part (228) by way of a second face surface (37), wherein the first and second face surfaces (36; 37) are situated opposite one another.

7. The fuel injection valve as claimed in claim 1, wherein, on an outer wall of the control piston (29), there is formed an annular groove (49) into which the inflow throttle (30) issues.

8. The fuel injection valve as claimed in claim 7, wherein the annular groove (49) is hydraulically separated from the second control chamber part (228) when the sealing surface (38) is in contact with the sealing seat (39).

9. The fuel injection valve as claimed in claim 1, wherein the control piston (29), when in an open state, is pressed by the spring element (33) against a positionally fixed stop (35).

* * * * *